US005560374A

United States Patent [19]

Viard

[11] Patent Number: 5,560,374

[45] Date of Patent: Oct. 1, 1996

[54] PATIENT SUPPORT APPARATUS AND METHOD

[75] Inventor: Jean-Louis B. Viard, Grabels, France

[73] Assignee: Hill-Rom, Inc., Batesville, Ind.

[21] Appl. No.: 413,518

[22] Filed: Mar. 30, 1995

[30] Foreign Application Priority Data

Apr. 6, 1994 [FR] France ..... 94 04011

[51] Int. Cl.[6] ..... A47C 27/00

[52] U.S. Cl. ..... 128/845; 5/611; 5/612

[58] Field of Search ..... 128/845, 846, 128/870; 5/453, 455, 456, 469, 914

[56] References Cited

U.S. PATENT DOCUMENTS

| | | | |
|---|---|---|---|
| 3,551,924 | 1/1971 | Frye | 5/448 |
| 4,542,547 | 9/1985 | Sato . | |
| 4,694,520 | 9/1987 | Paul et al. . | |
| 4,873,737 | 10/1989 | Savenije | 5/453 |
| 4,896,389 | 1/1990 | Chamberland . | |
| 4,949,413 | 8/1990 | Goodwin . | |
| 5,243,721 | 9/1993 | Tesdale | 5/453 |
| 5,251,349 | 10/1993 | Thomas | 5/453 |
| 5,349,983 | 9/1994 | Ozarowski | 5/453 |

FOREIGN PATENT DOCUMENTS

| | | | |
|---|---|---|---|
| 0218301 | 4/1987 | European Pat. Off. . | |
| 0403186 | 12/1990 | European Pat. Off. . | |
| 8908438 | 9/1989 | WIPO | 5/453 |

*Primary Examiner*—Sam Rimell
*Attorney, Agent, or Firm*—Barnes & Thornburg

[57] ABSTRACT

An apparatus is provided for supporting a patient. The apparatus includes a support device with inflatable chambers having a support top face and a bottom face. A detector measures the distance between the top face of the chamber and its bottom face. A servo-controller is provided for controlling the initial pressure inside the chamber to provide a relatively short predetermined reference distance between said top face of the chamber and said bottom face of the chamber. The apparatus also includes a controller coupled to the servo-controller to keep the distance between the top face and the bottom face of the chamber substantially constant while the patient is being supported.

18 Claims, 5 Drawing Sheets

CPU
42
120
VALVE
124a
124b
124c
VALVE
VALVE
MATCHER
52
PI REGULATOR
50
REF. ADJUSTER
AMPLIFIER
46
48 (Dc1)
140a
OSCILLATOR
44
MATCHER
52
PI REGULATOR
50
REF. ADJUSTR
AMPLIFIER
46
48 (Dc2)
140b
OSCILLATOR
44
MATCHER
52
PI REGULATOR
50
REF. ADJUSTER
46
48 (Dc3)
140c
OSCILLATOR
44
114a
130a
VALVE
122a
134a
114b
132
130b
B
122b
VALVE
134b
122c
VALVE
130c
134c
114c
112

PATIENT SUPPORT APPARATUS AND METHOD

The invention essentially relates to a method and an apparatus for supporting an element to be supported, in particular the body of a patient, enabling the element to be supported at a controlled penetration depth.

A device for supporting an element to be supported, in particular the body of a patient, is well known, and such a device is generally mainly referred to as a mattress.

In certain cases, such a device comprises at least one closed or controlled-release flexible chamber that is inflatable under a pressure that is a function of the allowed maximum penetration distance to which the element being supported can penetrate into the support. As a result, filling or emptying means are provided for filling or inflating said chamber until the penetration distance is decreased to below the allowed maximum penetration distance. To adapt such a support device to supporting patients of different weights, proposals have been made to modify the relatively high initial inflation pressure so as to enable as many different patients as possible to be supported, and, in the event that the pressure is not high enough, to increase said pressure so as to prevent an allowed limit penetration distance from being exceeded.

In Document EP-A-0 218 301=U.S. Pat. No. 4,873,737 proposals have been made to provide measurement means for measuring the distance between the top face of the chamber and the measurement device.

The sensor in the measurement device is based on the principle of a coupled circuit having electromagnetic coupling that is indirect (of the transformer type) and that varies as a function of the distance between the primary winding and the secondary winding of the coupled circuit (see FIG. 5 of the accompanying drawings).

A fixed-frequency oscillator delivers constant energy to the primary winding of a transformer. Said primary winding transfers varying energy to the secondary winding of the transformer, which varying energy varies as a function of the distance between the primary winding and the secondary winding of the transformer.

The energy collected at the secondary winding of the transformer is delivered to an amplifier.

When the maximum penetration depth is reached, the pressure is modified. Therefore, penetration varies as a function of patient weight.

In contrast, an object of the present invention is to solve a new technical problem consisting in providing means for enabling the patient to penetrate into the support device, such as a mattress, to an essentially constant depth independently from the weight of the patient, so as to allow the element being supported, such as the body of a patient, to penetrate deeply into the support device, thereby obtaining improved weight distribution over the surface of the support.

Another object of the invention is to solve the above-mentioned new technical problem so as to improve the distribution of the weight of the body of a patient, thereby enabling the support device to be used therapeutically to ensure that local pressure does not prevent blood circulation, in order to prevent bedsores from forming.

These technical problems are solved for the first time by the present invention, in a safe and reliable manner, in a way that is particularly simple, that is cheap, and that can be used on an industrial and medical scale.

A support device of the invention includes a sensor whose principal is based on varying the self-induction coefficient of a coil, which is a separate element of an oscillator.

The variation in the self-induction coefficient is caused by varying the distance between the coil and a metal film situated under the element being supported, such as the body of a patient. Such variation is a function of the extent to which an element being supported, such as the body of a patient, penetrates into the support device, and said variation moves the resonant frequency of the LC circuit away from the tuning frequency of the oscillator, thereby causing the signal delivered by the oscillator to the amplifier to be damped.

In a first aspect, the present invention provides a method of supporting an element to be supported, in particular the body of a patient, comprising providing: at least one support device comprising at least one closed or controlled-release flexible chamber that is inflatable under an adjustable predetermined initial inflation pressure, said chamber having a top face and a bottom face; servo-control means for servo-controlling the filling pressure of said chamber as a function of the penetration distance to which the element being supported penetrates into the support device, which servo-control means comprise filling means or emptying means for filling or emptying a filling fluid for filling said chamber under said pressure; and distance measurement means for measuring the distance (D) between the top face of the chamber and its bottom face; said method being characterized in that the initial inflation pressure of said chamber is servo-controlled to a penetration distance that is adapted so that the element being supported, in particular the body of a patient, penetrates deeply into the support device, thereby bringing said top face of said chamber to a relatively short predetermined reference distance ($D_c$) from the bottom face of said chamber, and in that, while the element to be supported, in particular the body of a patient, is being supported, the top face is kept essentially at the predetermined reference distance, in particular by acting on the servo-control means as a function of the measurements supplied by the above-mentioned distance measurement means.

In an advantageous implementation of the method, while the element to be supported, in particular the body of a patient, is being supported, the distance between the top face and the bottom face of the chamber lies in the range 20% to about 80%, and preferably in the approximate range 20% to 40%, of the initial distance between the top face and the bottom face of the chamber, as measured while no element is being supported. The invention preferably uses a mattress that is about 20 cm thick, and the penetration is about 15 cm, so that the reference distance ($D_c$) is 5 cm, i.e. about 20% of the initial distance or thickness.

In a currently preferred implementation of the method of the invention, the measurement means include a metal element, advantageously in the form of a thin film, placed under the most protuberant or heaviest portion of the element being supported, in particular the body of a patient, said metal element being secured to the top face of the chamber, and co-operating with at least one inductive element forming a position detector secured to the bottom face of said chamber, in particular being disposed under the bottom face of said chamber.

In an advantageous implementation, a pressure lying in the range 4 mbars to 40 mbars is required to achieve the desired penetration of the element being supported at said reference distance.

It can be understood that the principle used by the invention to detect the penetration of the body being supported is fundamentally different from the principles used in the prior art. Using the principle of the present invention to detect the penetration of the body being supported, the distance between the top face and the bottom face of the chamber is kept essentially constant at said reference distance while the element to be supported, in particular the body of a patient, is being supported, regardless of the weight, the position, the morphology, and more precisely the morphological outline of the patient. In this way, the best possible distribution of weight is achieved over the top face of the support chamber. When the distance changes, the means for filling or emptying the chamber-filling fluid are actuated so as to fill or to empty said fluid, thereby modifying the filling pressure and restoring said reference distance.

In a second aspect, the present invention also provides an apparatus for supporting an element to be supported, in particular the body of a patient, the apparatus comprising: a support device comprising at least one closed or controlled-release flexible chamber that is inflatable under an adjustable predetermined initial inflation pressure, said chamber having a top face serving to support the element to be supported, and a bottom face; servo-control means for servo-controlling the filling pressure of said chamber as a function of the penetration distance to which the element being supported penetrates into the support device, which servo-control means comprise filling means, or emptying means for filling or emptying a filling fluid; measurement means for measuring the distance (D) between the top face of the chamber and its bottom face; and control means for controlling the servo-control means for controlling the pressure; said apparatus being characterized in that the servo-control means for servo-controlling the filling pressure are organized so as to servo-control the initial pressure to a relatively short predetermined reference distance ($D_c$) between said top face of the chamber and said bottom face of the chamber, the control means acting on the servo-control means for servo-controlling the inflation pressure of said chamber to keep the distance (D) between the top face and the bottom face of the chamber essentially constant while the element is being supported.

In an advantageous embodiment, the above-mentioned measurement means include a metal element, advantageously in the form of a thin metal film, secured to the top face of the chamber inside said chamber, and co-operating with at least one inductive element forming a position detector secured to the bottom face of said chamber, which inductive element may be disposed inside said chamber, integrated into the bottom face of the chamber, or else it may secured to the outside of said bottom face of the chamber.

The above-mentioned control means may advantageously include a control station advantageously comprising an electronic or electro-mechanical central processing unit having a memory, which unit continuously or intermittently receives signals that are proportional to the value of the distance between the top face and the bottom face of the chamber, said signals being transmitted by the above-mentioned measurement means, said central processing unit comparing the measured values with the reference distance value and controlling the servo-control means for servo-controlling the inflation pressure of the chamber so that a measured distance that is essentially equal to the reference distance is constantly obtained.

In another advantageous embodiment of the invention, a plurality of inductive elements forming position detectors distributed over the bottom face of the support device may be provided.

It can be understood that the invention solves the above-mentioned technical problems, thereby offering the corresponding technical advantages. In particular, an improved distribution of pressure is constantly achieved over the supporting top face of the chamber, regardless of the weight, the position, the morphology, and more precisely the morphological outline of the patient, thereby preventing the blood circulation from being stopped, and therefore preventing bedsores from forming. Therefore, the invention may be used in the medical field for supporting patients for therapeutic purposes.

In another advantageous embodiment of the invention, in the vicinity of that region of the element being supported which has the largest mass or which is most protuberant, in particular the sacral or trochanteral region of a patient, a reinforcing member may be provided to limit the penetration distance of the top face of the chamber over said region, relative to the remaining regions, thereby taking into account the region of greatest mass or protuberance. For example, the reinforcing member may comprise a foam under-mattress or an inflatable cushion, and it may advantageously be lenticular in shape.

In another advantageous embodiment of the invention, the above-mentioned reference distance lies in the range 20% to about 80%, and preferably in the approximate range 20% to 40%, of the initial distance between the top face and the bottom face of the chamber, as measured while no element is being supported. For example, with a mattress that has an initial thickness of about 20 cm, while no clement is being supported, the preferred reference distance is about 5 cm, i.e. about 20% of the initial thickness, corresponding to a penetration of about 15 cm.

Other objects, characteristics and advantages of the invention will appear clearly to a person skilled in the art on reading the following description of a plurality of currently-preferred embodiments of the invention given by way of non-limiting example and with reference to the accompanying drawings, in which.

Figure 1:
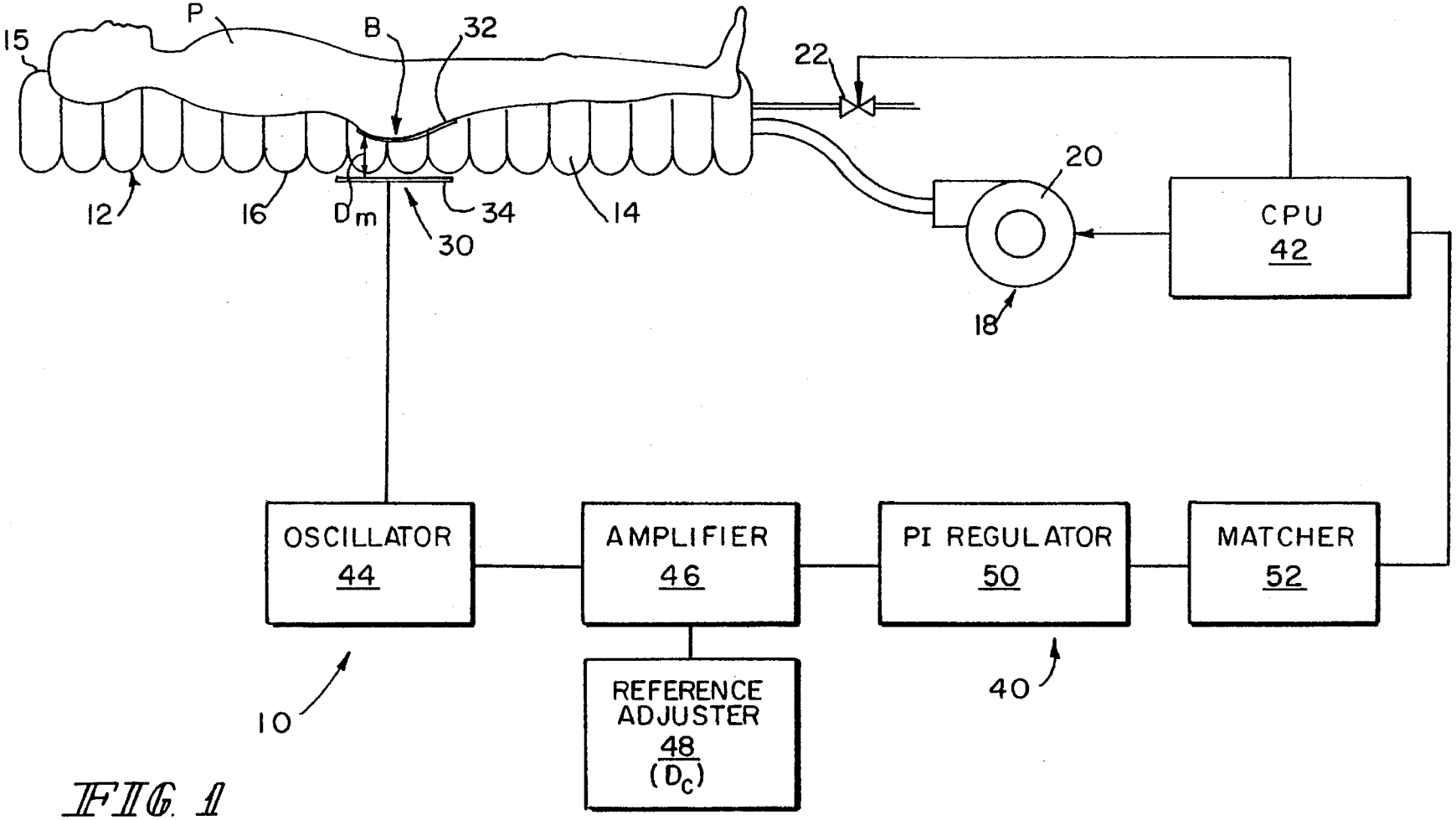
FIG. 1 is a diagrammatic view showing a first embodiment of support apparatus of the present invention, including a support device having a single chamber.
Figure 2:
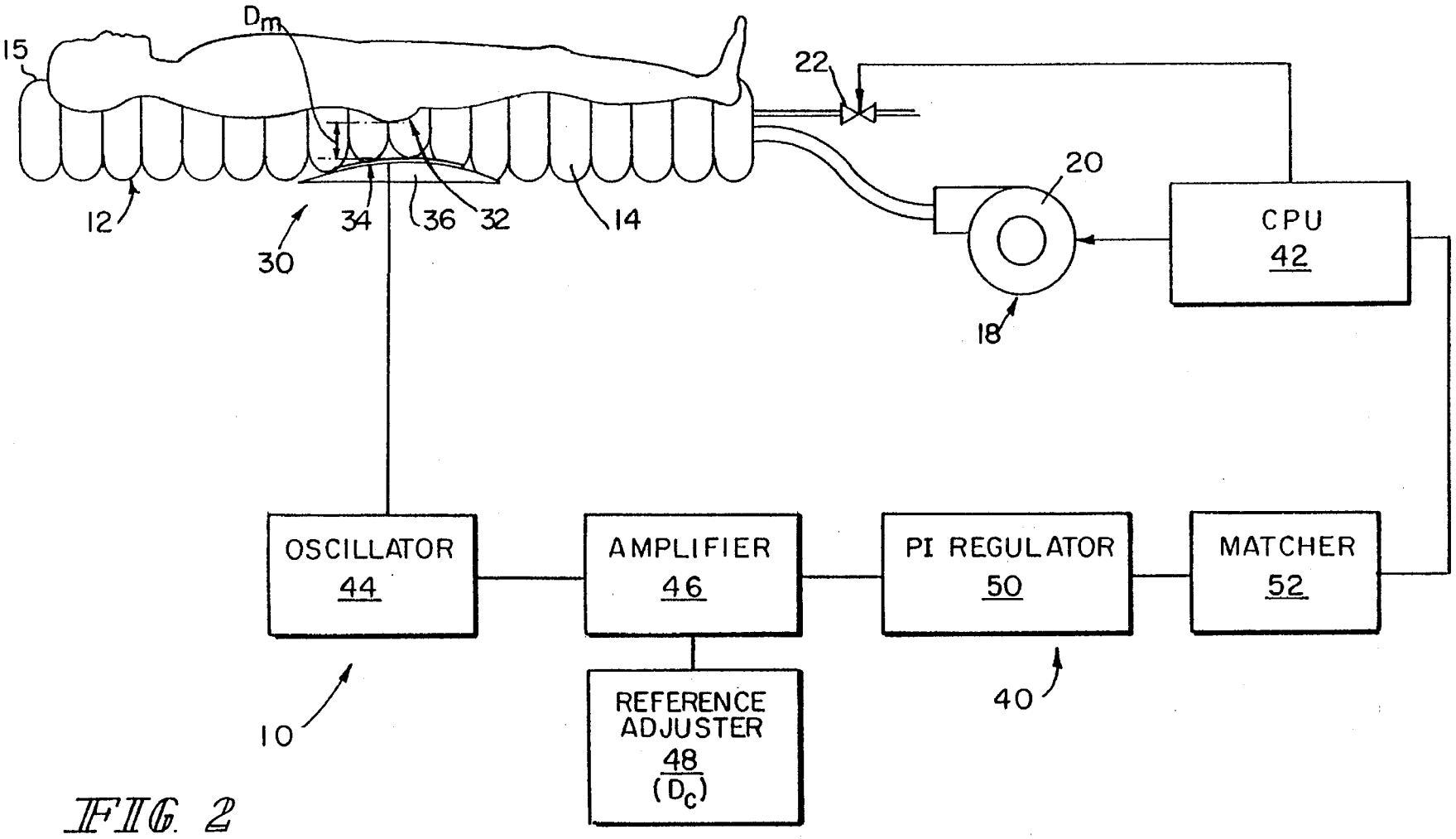
FIG. 2 shows a variant of the embodiment shown in FIG. 1, with a reinforcing member being disposed in the vicinity of that region of the element which has the largest mass or which is most protuberant, namely the sacral region in this example.
Figure 3:
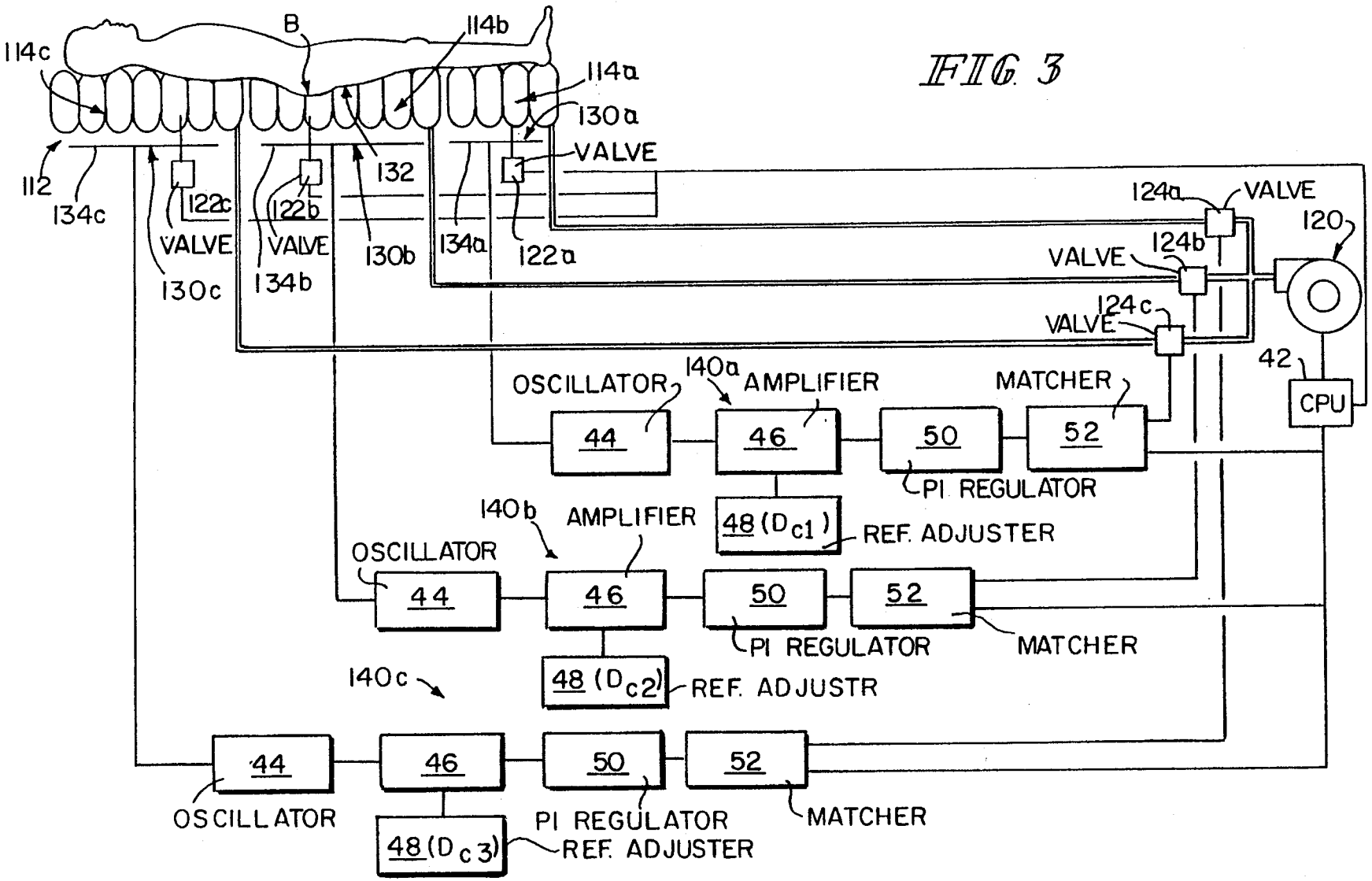
FIG. 3 shows a second embodiment of support apparatus of the present invention, in which the support device comprises a plurality of chambers, namely three chambers in this example.
Figure 4:
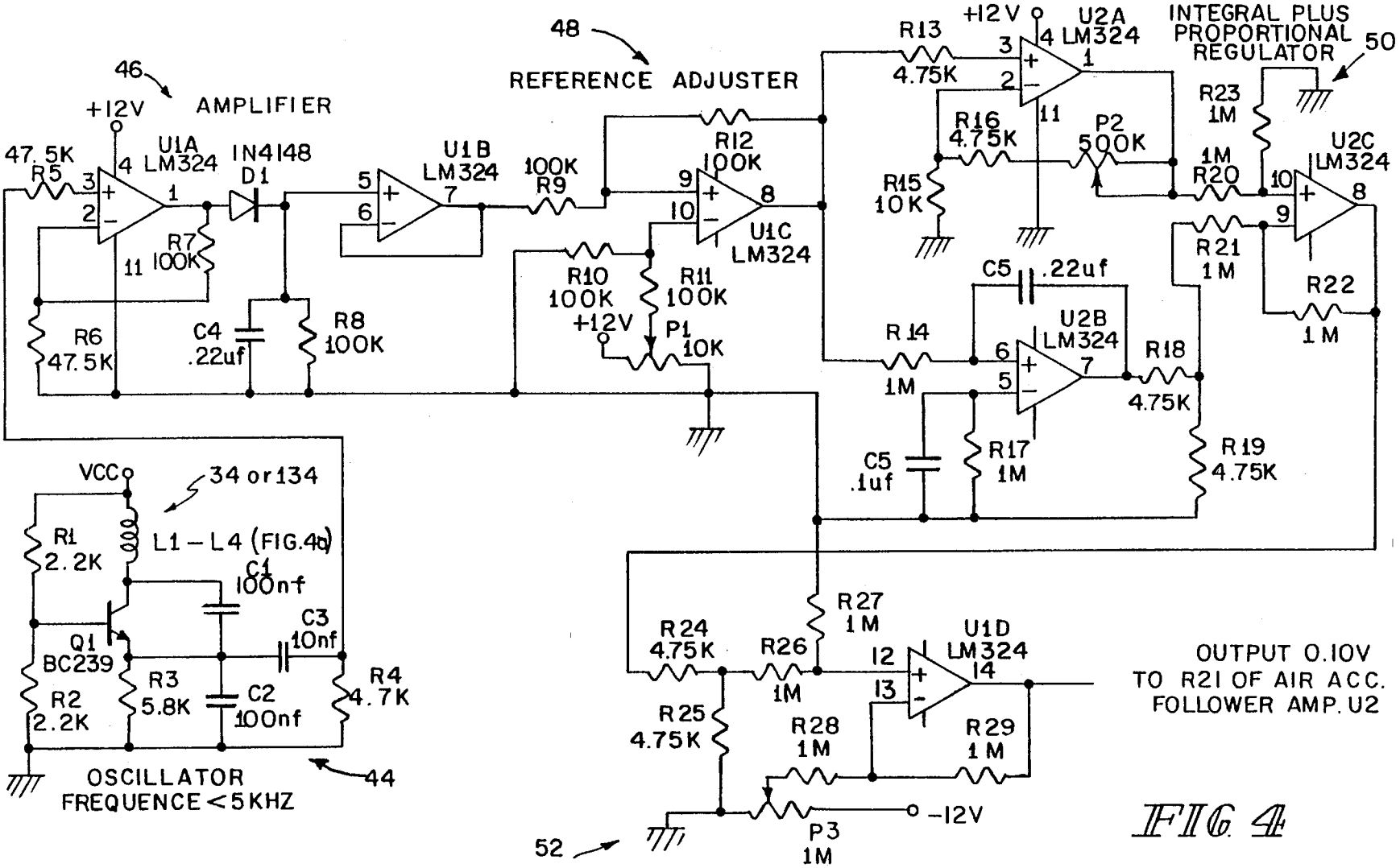
Figure 4A:
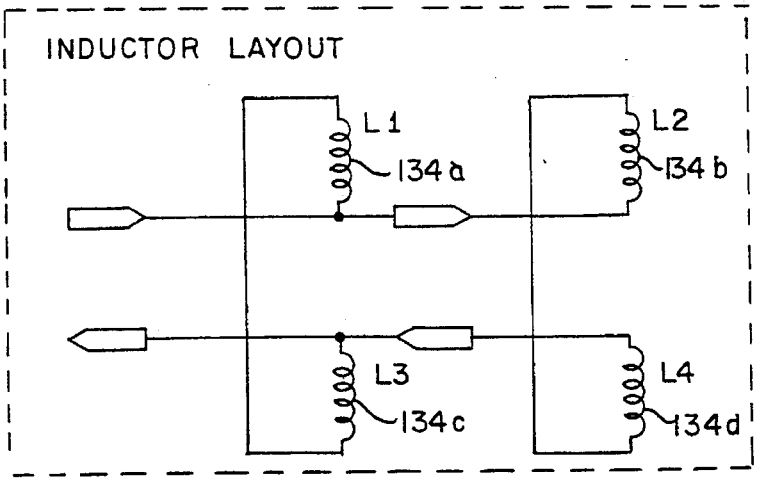
Figure 5:
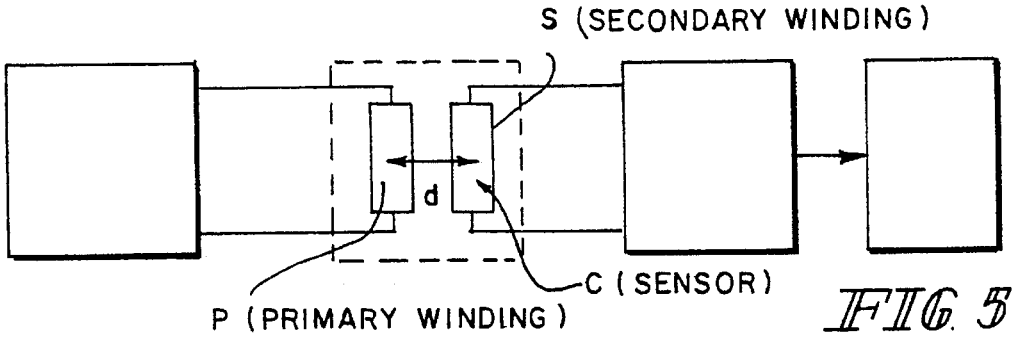
FIG. 5 (PRIOR ART)
Figure 6:
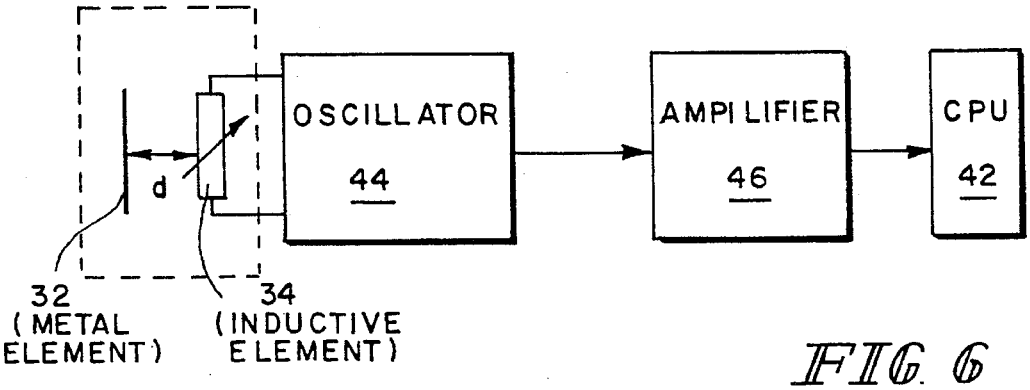

FIGS. 4 and 4*a* show the electronic circuit of the apparatus in another embodiment that is similar to the embodiment shown in FIG. 3, but in which the support device comprises four chambers, the modifications that need to be made to the electronic circuit for the embodiments shown in FIGS. 1 to 3 being clearly apparent to a person skilled in the art;

FIG. 5 is a block diagram showing the operating principle of prior art apparatus, namely EP-A-0 218 301=U.S. Pat. No. 4,873,737; and FIG. 6 shows the operating principle of an apparatus according to the present invention, shown in FIGS. 1 to 4a, thereby enabling the fundamental difference in the way the apparatus of the invention operates to be observed by merely comparing FIGS. 5 and 6.

FIG. 1 shows a support apparatus of the present invention given the overall reference 10. This support apparatus makes it possible to support an element, in particular the body of a patient P, as shown.

The apparatus 10 includes a support device proper 12 comprising at least one closed or controlled-release chamber 14 that is flexible and inflatable. For example, the chamber may be composed of a multitude of inflatable tubes that communicate with one another, said chamber 14 being inflatable under an adjustable predetermined initial inflation pressure. The chamber 14 has a top face 15 serving to support the element to be supported P, and a bottom face 16 which may, for example, rest on a base (not shown) or on equivalent means. The apparatus further includes servo-control means 18 for servo-controlling the pressure at which the chamber 14 is filled as a function of the penetration distance of the element being supported, i.e. the distance to which it penetrates into the support device. For example, said servo-control means may comprise filling means 20, such as pumping means 20 for pumping a filling fluid, in particular air, or a liquid, in particular water, into the chamber 14, or it may comprise emptying means such as a valve 22.

The apparatus also includes measurement means 30 for measuring the distance D between the top face 15 of the chamber and its bottom face 16.

In accordance with the present invention, the apparatus is further characterized in that the servo-control means 18 for servo-controlling the filling pressure of the chamber 14 are organized so as to servo-control the initial pressure to a relatively short predetermined reference distance ($D_c$) between said top face of the chamber and said bottom face of the chamber. In general, this is achieved by servo-controlling the pressure to a relatively low pressure level, thereby enabling the element, in particular the body of a patient P, to penetrate deeply while it is being supported, so as to bring the top face 15 of the chamber 14 relatively close to the bottom face 16 of the chamber 14, so that they are at a reference distance $D_c$ apart, at least in the vicinity of that region of the element being supported which has the largest mass or which is the most protuberant, such as the sacral region B. The apparatus 10 also includes control means 40 that act on the servo-control means 18 for servo-controlling the inflation pressure of the chamber 14 to keep the distance D as measured between the top face 15 and the bottom face 16 of the chamber 14 essentially constant while the element is being supported, i.e. essentially equal to the reference distance $D_c$, or within an acceptable range of variation thereabout.

In an advantageous embodiment of the invention, the measurement means 30 include a metal element 32, advantageously in the form of a thin film, secured to the top face 15 of the chamber 14 inside said chamber 14, as shown, and co-operating with at least one inductive element 34 forming a position detector secured to the bottom face 16 of said chamber, which inductive element may be disposed inside said chamber 14, integrated into the bottom face of the chamber 16, or else it may secured to the outside of said bottom face 16 of the chamber 14, as shown.

The above-mentioned control means 40 may advantageously include a control station 42 comprising an electronic or an electro-mechanical central processing unit having a memory, which unit continuously or intermittently receives signals that are proportional to the value of the distance, $D_m$, as measured between the top face 15 and the bottom face 16 of the chamber, said signals being transmitted by the above-mentioned measurement means, said central processing unit comparing the measured values with the reference distance value, $D_c$, and controlling the servo-control means 20, 22 for servo-controlling the inflation pressure of the chamber 14 so that a measured distance, $D_m$, that is essentially equal to the reference distance, $D_c$, is constantly obtained.

The control means 40 may include an oscillator device 44 coupled to the inductive element 34, such as an induction coil, an amplifier device 46 whose gain may be adjusted by a reference adjustment device 48. The amplifier is then coupled to a proportional-plus-integral regulation device 50 coupled to a matching device 52 whose output is coupled to the control station 42.

The control means 40 can be clearly understood by a person skilled in the art, and the way they operate is described below after the description of the embodiments.

FIG. 2 shows a variant of the embodiment shown in FIG. 1, in which the inductive element 34, such as an induction coil, is disposed on a reinforcing member 36 disposed in the vicinity of that region B of the element being supported P which has the largest mass or which is most protuberant, namely the sacral region in this example, so as to limit the penetration distance of the top face 15 of the chamber over said region B, relative to the remaining regions, thereby taking into account the region of greatest mass or protuberance, as can be understood by a person skilled in the art, in particular by comparing FIGS. 1 and 2. For example, the reinforcing member 36 may comprise a foam under-mattress which may advantageously be lenticular in shape and have its convex face facing the element being supported, as shown. It is also possible to use a reinforcing member constituted by another chamber that can be inflated to a different pressure.

To this end, FIG. 3 shows a second embodiment of apparatus of the present invention, in which the elements that are identical to or that have functions identical to the elements shown in FIG. 1 are referenced by the same reference numbers plus one hundred. In this embodiment, instead of using a single chamber 14, a plurality of independent chambers are used, e.g. three chambers such as **114*a*, 114*b*, 114*c*, each of which is provided with respective measurement means such as 130*a*, 130*b*, 130*c*. In this second embodiment, each of the measurement means such as 130*a*, 130*b*, 130*c* may include a respective inductive element 134*a*, 134*b*, 134*c* or 134*d* (shown in FIG. 4) which may be combined with a single metal element 132, or optionally with a plurality of metal elements. In the embodiment shown in FIG. 3, a single metal element 132** is used disposed in the vicinity of that region of the element being supported which has the largest mass or which is the most protuberant, namely the sacral region B in this example.

As a result, respective control means such as **140*a*, 140*b*, and 140*c* identical to those shown in FIGS. 1 and 2 are associated with each of the measurement means such as 130*a*, 130*b*, and 130*c*. The filling means 120 such as pumping means for pumping a filling fluid may be connected to each chamber, such as 114*a*, 114*b*, and 114*c*, via a respective open/close control valve such as 124*a*, 124*b*, 124*c* enabling the chamber to be inflated, or stopping it from being inflated. Individual outlet valves 122*a*, 122*b*, 122*c* may also be provided for partially deflating the chamber 114*a*, 114*b*, or 114*c*** so as to servo-control the inflation pressure in each chamber to the penetration distance of the element being supported.

The invention advantageously uses a metal element in the form of a thin film, e.g. which may be 10 μm thick, placed inside the chamber 14 or **114*b*, between two insulating films so as to increase responsiveness. For example, the thickness of the support element 12 or 112** may be 20 cm. The low initial inflation pressure is advantageously provided so as to enable the element being supported, such as the body of a patient P, to penetrate deeply into the mattress-forming support device, to a constant depth, e.g. 15 cm, independently of the weight of the patient, e.g. for a range of weights going from 20 kg to 100 kg, independently of patient morphology and regardless of whether the body of the patient P is in the recumbent position or in the sitting position.

For example, the low initial inflation pressure used for supporting a patient weighing about 75 kg so that the most protuberant portion, i.e. the sacral region, penetrates into a mattress inflated with air and having an initial thickness of 20 cm to a depth of 15 cm, lies in the range 15 mbars to 16 mbars.

For example, the inductive element 34 or 134*a*, 134*b*, or 134*c* may be formed by a flat coil that is constantly powered by a very low voltage of about 3 V and that passes a current of a few micro-amps.

The inductive element 34 or 134*a*, 134*b*, 134*c*, is part of an LC tuning circuit whose capacitance component is preferably constant, with its inductance component being modified during displacement of the metal element 32 or 132, e.g. in the form of a film.

By combining the metal element 32 or 132 with the inductive element(s) 34 or 134*a*, 134*b*, or 134*c*, any variation in distance causes a variation in inductance L, in the same way as a proximity detector for an inductive sensor, thereby detuning the oscillator circuit 44.

The inductive element 34 or 134*a*, 134*b*, 134*c*, is constantly powered by a low-voltage sinewave current, e.g. a current of a few micro-amps, and a voltage of about 3 V, thereby enabling an induced current to be delivered to the oscillator device 44.

FIGS. 4 and 4*a* show a circuit diagram representing the electronic circuit provided in another embodiment of apparatus of the present invention, similar to the embodiment shown in FIG. 3, but including four chambers, and therefore four associated inductive elements 134*a*, 134*b*, 134*c*, and 134*d*.

With reference to FIGS. 1 to 4, 4*a* and 6, the oscillator device 44 receives the induced current from the inductive element 34 or 134. For example, the oscillator device 44 may oscillate at a frequency of about 4 kHz. The oscillator device 44 also performs frequency discrimination by converting a frequency variation to a voltage variation by means of the structure of the electronic circuit shown in FIG. 4. Since the voltage delivered by the oscillator 44 is relatively low, said voltage is amplified by the amplifier device 46. At the output of the amplifier 46, the voltage signal is rectified by the diode, and is then filtered so as to recover only the DC component of the signal. The reference adjustment device 48 is obtained by using a comparator device comprising an operational amplifier 9, 10 mounted as a comparator. By using this layout, a signal is obtained that is proportional to the difference between the measurement signal supplied by the rectifying amplifier circuit 46 and the reference voltage of the reference adjustment device 48 adjusted by a potentiometer P1.

The output of the reference adjustment device 48 is connected to the proportional-plus-integral regulation device 50 which integrates the signal so as to have no hunting or oscillation effect around the reference point, for the comfort of the patient.

The output of the proportional-plus-integral regulation device 50 is connected to the matching device 52 which is also constituted by an operational amplifier and a potentiometer P3, and which makes it possible to deliver an output signal, e.g. of about 0.10 volts, that can be applied to the control station 42 which then controls the servo-control means 20, 22 or 120, 122, 124 for servo-controlling the pressure to the penetration distance of the element being supported, e.g. the pumping means 20 or 120 such as a pump making it possible to modify the feed speed of the inflation fluid, such as air, or to reduce the pressure by controlling the motorized valve 22 or 122*a*, 122*b* or 122*c*, so as to open it or to modify its open section.

It is possible to organize operation such that the chamber 14 or 114*a*, 114*b*, 114*c* loses inflation fluid, such as air, at a constant rate, the feed means 20 or 120, such as a pump, then enabling the inflation fluid, such as air, to be injected continuously or pulsed intermittently so as to maintain the desired inflation pressure.

It can be understood that in the invention, and with reference to the electronic circuit shown in FIGS. 1 to 4*a* and 6, the distance D to which the body of the patient P penetrates into the mattress formed by the chamber 14 or 114 may be converted to a reference voltage which may be set and adjusted by means of the potentiometer P1 of device 48.

When the voltage of the signal supplied by the amplifier device 46 as a function of the distance measured between the metal element 32 or 132 and the inductive element(s) 34, 134*a*, 134*b*, 134*c*, or 134*d* is greater than the reference voltage, a DC voltage is obtained at the output of the comparator device that causes an increase in the inflation of the chamber(s).

If the voltage of the signal is less than the reference voltage, a positive voltage is obtained at the output of the comparator-forming reference adjustment device which then causes the inflation pressure inside the chamber(s) to decrease by opening the corresponding valves 22 or 122, or by increasing the opening when the apparatus operates by constant fluid loss.

Naturally, when the two voltages are equal, a zero voltage is obtained at the output of the comparator, and no inflation or deflation is generated.

The presence of the proportional-plus-integral regulation device 50 is important because it prevents hunting phenomena from occurring on the feedback circuits. Without the proportional-plus-integral regulation device 50, hunting phenomena occur when the pressure becomes too low, because the reference point is quickly overshot, and the servo-control system gives the opposite order to slow down the flow-rate, thereby making it possible for the reference point to be overshot again. The hunting phenomenon is thus initiated, with very disagreeable consequences for the patient.

The proportional-plus-integral regulation loop 50 is damped by means of integration and fast evaluation, so as to remain constantly at the reference point. When the support device comprises only one chamber, as shown in FIGS. 1 and 2, it is preferable to provide a reinforcing member such as element 36 which may be a foam element or an inflated cushion enabling the body of the patient P to be brought back to the horizontal, while enabling a low pressure to be put in the mattress, as shown in FIG. 2. The reinforcing member 36 is advantageously used on single-chamber support devices.

In contrast, in a multi-chamber support device, as shown in FIGS. 3 and 4, respectively showing a device having three chambers and a device having four chambers, it is simpler to set different reference points for each circuit, such as 140*a*, 140*b*, 140*c* or 140*d* coupled to a respective inductive element 134*a*, 134*b*, 134*c*, or 134*d* (the fourth element not being shown in FIG. 3).

It can be understood that the invention makes it possible to solve the above-mentioned technical problems, and to offer the above-described major technical advantages.

By comparing the block diagrams of FIGS. 5 and 6 that respectively show how prior art apparatus described in EP-A-0 218 301=U.S. Pat. No. 4,173,737 (FIG. 5) operates, and how apparatus of the of the present invention (FIG. 6) operates, it can also easily be understood that, in the prior art shown in FIG. 5, the sensor C of the measurement device is based on the principle of the coupled circuit, having indirect electromagnetic coupling of the transformer type that varies as a function of the distance between the primary winding P and the secondary winding S of the coupled circuit.

In contrast, in apparatus of the present invention, as shown in FIG. 6, the sensor comprises a metal element 32 that co-operates with an inductive element 34 which constitutes a separate element of an oscillator. As a result, when the distance (D) between the metal element 32 and the inductive element 34 varies, the self-induction coefficient varies, thereby modifying the resonant frequency of the LC circuit by moving it away from the tuning frequency of the oscillator. An advantage of this is that the signal delivered to the amplifier by the oscillator is damped.

The invention covers any characteristic which appears to be novel compared with any state of the art. Furthermore, the invention covers any means constituting techniques that are equivalent to the means described, and the various possible combinations thereof. FIGS. 1 to 4*a* and 6 form an integral part of the present invention and therefore of the description.

I claim:

1. In a method of supporting a body comprising the steps of providing at least one support device comprising at least one closed or controlled-release flexible chamber that is inflatable under an adjustable predetermined initial inflation pressure, said chamber having a top face and a bottom face; servo-control means for servo-controlling the filling pressure of said chamber as a function of the penetration distance to which the body being supported penetrates into the support device, which servo-control means comprises at least one of filling means and emptying means for filling and emptying a filling fluid for filling said chamber under pressure; and distance measurement means for measuring the distance ($D_c$) between the top face of the chamber and its bottom face; the improvement comprising the steps of servo-controlling the initial inflation pressure of said chamber to a penetration distance that is adapted so that the body penetrates into the support device, thereby bringing said top face of said chamber to a predetermined reference distance ($D_c$) from the bottom face of said chamber, and in that, while the body is being supported, the top face is kept essentially at the predetermined reference distance, in particular by acting on the servo-control means as a function of the measurements supplied by the distance measurement means, and wherein the step of measuring said distance ($D_c$) includes the step of varying an output of an oscillator based on changes on the distance ($D_c$), the variable oscillator output signal being used in the servo-controlling step.

2. The method of claim 1, wherein, while the body is being supported, the distance between the top face and the bottom face of the chamber lies in the range 20% to about 80%, and preferably in the approximate range 20% to 40%, of the initial distance between the top face and the bottom face of the chamber, as measured while no body is being supported.

3. The method of claim 1, wherein the measurement means include a metal element placed under the most protuberant or heaviest portion of the body, said metal element being secured to the top face of the chamber, and cooperating with at least one inductive element forming a position detector secured to the bottom face of said chamber.

4. The method of claim 1, wherein initial inflation low pressure lies in the range 4 mbars to 40 mbars.

5. In an apparatus for supporting a body comprising: a support device including at least one closed or controlled-release flexible chamber that is inflatable under an adjustable predetermined initial inflation pressure, said chamber having a top face serving to support the body, and a bottom face; servo-control means for servo-controlling the filling pressure of said chamber as a function of the penetration distance to which the body being supported penetrates into the support device, which servo-control means includes at least one of filling means and emptying means for filling and emptying a filling fluid; measurement means for measuring the distance (D) between the top face of the chamber and its bottom face; and control means for controlling the servo-control means for controlling the pressure; the improvement comprising said servo-control means for servo-controlling the filling pressure being configured to servo-control the initial pressure to a predetermined reference distance ($D_c$) between said top face of the chamber and said bottom face of the chamber, the control means acting on the servo-control means for servo-controlling the inflation pressure of said chamber to keep the distance (D) between the top face and the bottom face of the chamber essentially constant while the body is being supported, and a reinforcing member configured to elevate the bottom face in a region of the chamber which is located below a portion of the body which has the largest mass, the reinforcing member thereby causing the servo-control means to limit the penetration distance of the top face in said region of the chamber.

6. The apparatus of claim 5, wherein the measurement means include a metal element secured to the top face of the chamber inside said chamber, and co-operating with at least one inductive element forming a position detector secured to the bottom face of said chamber.

7. The apparatus of claim 5, wherein the control means includes a control station advantageously comprising an electronic or electro-mechanical central processing unit having a memory, which unit continuously or intermittently receives signals that are proportional to the value of the distance ($D_m$) between the top face and the bottom face of the chamber, said signals being transmitted by the above-mentioned measurement means, said central processing unit comparing the measured values with the reference distance value ($D_c$) and controlling the servo-control means for servo-controlling the inflation pressure of the chamber so that a measured distance ($D_m$) that is essentially equal to the reference distance ($D_c$) is constantly obtained.

8. The apparatus of claim 5, comprising a plurality of inductive elements forming position detectors distributed over the bottom face of the support device.

9. The apparatus of claim 5, wherein the reinforcing member is one of a foam under-mattress, an inflatable cushion, and a lenticular-shaped inflatable cushion.

10. The apparatus of claim 5, wherein the support device is a mattress.

11. The apparatus of claim 10, wherein the mattress is an anti-bedsore mattress.

12. The apparatus of claim 11, wherein the initial inflation pressure lying in the range 4 mbars to 40 mbars.

13. A method for supporting a body of a patient comprising the steps of providing at least one support device including at least one flexible inflatable chamber having an adjustable predetermined initial inflation pressure, said chamber having a top face and a bottom face, adjusting the filling pressure of said chamber as a function of a penetration distance to which the body being supported penetrates into the support device by controlling a pump to fill the chamber with a filling fluid under pressure and by controlling a valve for removing fluid from the chamber, measuring a distance between the top face of the chamber and its bottom face, setting the initial inflation pressure of said chamber so that the supported body penetrates into the support device until said top face of said chamber is a predetermined reference distance from the bottom face of said chamber, and maintaining the top face substantially at the predetermined reference distance from the bottom face by controlling the filling pressure in the adjusting step based on the measured distance from the measuring step, the predetermined reference distance being about 20% to about 40% of an initial distance between the top face and the bottom face of the chamber, as measured while no body is being supported.

14. The method of claim 13, wherein initial inflation low pressure lies in the range 4 mbars to 40 mbars.

15. An apparatus for supporting an element, the apparatus comprising:

a support device including at least one inflatable flexible chamber having an adjustable predetermined initial inflation pressure, said chamber having a top face configured to support the element and a bottom face;

a pump and a valve for filling and emptying a filling fluid from the chamber, respectively;

a detector to measure a distance between the top face of the chamber and its bottom face, the detector including an inductive element forming a portion of an oscillator, the inductive element varying an output signal of the oscillator in response to changes in the distance between the top face and the bottom face; and a controller coupled to the pump and valve for controlling the filling pressure of said chamber as a function of a penetration distance to which the element being supported penetrates into the support device, the controller being configured to adjust the inflation pressure in the chamber to establish a predetermined reference distance between said top face of the chamber and said bottom face of the chamber based on the variable output of the oscillator, the controller adjusting the inflation pressure in said chamber to maintain the distance between the top face and the bottom face of the chamber essentially at substantially the predetermined reference distance while the element is being supported.

16. An apparatus for supporting an element, the apparatus comprising:

a support device including at least one inflatable flexible chamber having an adjustable predetermined initial inflation pressure, said chamber having a top face configured to support the element and a bottom face;

a pump and a valve for filling and emptying a filling fluid from the chamber, respectively;

a detector to measure a distance between the top face of the chamber and its bottom face, the detector including a metal element coupled to the top face of the chamber inside said chamber, and at least one inductive element forming a position detector located adjacent the bottom face of said chamber; and a controller coupled to the pump and valve for controlling the filling pressure of said chamber as a function of a penetration distance to which the element being supported penetrates into the support device, the controller being configured to adjust the inflation pressure in the chamber to establish a predetermined reference distance between said top face of the chamber and said bottom face of the chamber, the controller adjusting the inflation pressure in said chamber to maintain the distance between the top face and the bottom face of the chamber essentially at substantially the predetermined reference distance while the element is being supported.

17. The apparatus of claim 16, further comprising a reinforcing member located beneath the support device.

18. An apparatus for supporting an element, the apparatus comprising:

a support device including at least one inflatable flexible chamber having an adjustable predetermined initial inflation pressure, said chamber having a top face configured to support the element and a bottom face;

a pump and a valve for filling and emptying a filling fluid from the chamber, respectively;

a detector to measure a distance between the top face of the chamber and its bottom face; and a controller coupled to the pump and valve for controlling the filling pressure of said chamber as a function of a penetration distance to which the element being supported penetrates into the support device, the controller being configured to adjust the inflation pressure in the chamber to establish a predetermined reference distance between said top face of the chamber and said bottom face of the chamber, the controller adjusting the inflation pressure in said chamber to maintain the distance between the top face and the bottom face of the chamber essentially at substantially the predetermined reference distance while the element is being supported, the controller comprising a control station including a central processing unit having a memory, which central processing unit receives a signal from the detector that is proportional to the distance between the top face and the bottom face of the chamber, said central processing unit comparing the signals from the detector with the predetermined reference distance and controlling the pump and valve to adjust inflation pressure of the chamber so that a measured distance that is substantially equal to the predetermined reference distance.

* * * * *